US012589321B2

(12) United States Patent
Wisniewski

(10) Patent No.: US 12,589,321 B2
(45) Date of Patent: Mar. 31, 2026

(54) HAND OPERATED GYROSCOPE DEVICE

(71) Applicant: John Wisniewski, Wauwatosa, WI (US)

(72) Inventor: John Wisniewski, Wauwatosa, WI (US)

( * ) Notice: Subject to any disclaimer, the term of this patent is extended or adjusted under 35 U.S.C. 154(b) by 180 days.

(21) Appl. No.: 18/526,297

(22) Filed: Dec. 1, 2023

(65) Prior Publication Data

US 2024/0189729 A1 Jun. 13, 2024

Related U.S. Application Data

(60) Provisional application No. 63/386,579, filed on Dec. 8, 2022.

(51) Int. Cl.

| | |
|---|---|
| ***A63B 23/14*** | (2006.01) |
| ***A63B 21/22*** | (2006.01) |
| ***A63B 23/16*** | (2006.01) |
| ***A63H 29/20*** | (2006.01) |
| ***A63H 29/24*** | (2006.01) |
| ***A63H 31/08*** | (2006.01) |
| ***A63H 33/00*** | (2006.01) |

(52) U.S. Cl.

CPC ..... *A63H 33/002* (2013.01); *A63B 21/222* (2015.10); *A63B 21/227* (2013.01); *A63B 23/14* (2013.01); *A63B 23/16* (2013.01); *A63H 29/20* (2013.01); *A63H 29/24* (2013.01); *A63H 31/08* (2013.01)

(58) Field of Classification Search

CPC ..... A63B 21/22; A63B 21/222; A63B 21/225; A63B 21/227; A63B 23/14; A63B 23/16; Y10T 74/12; A63H 29/20; A63H 29/24; A63H 31/08; A63H 33/002

USPC ..... 446/233; 482/44, 45

See application file for complete search history.

(56) References Cited

U.S. PATENT DOCUMENTS 3,726,146 A * 4/1973 Mishler ..... G01C 19/02 446/233
4,150,580 A * 4/1979 Silkebakken ..... A63B 21/222 446/233
4,479,326 A * 10/1984 Kennedy ..... A63H 29/24 446/23
4,556,396 A * 12/1985 Kennedy ..... A63H 29/24 446/233
4,684,124 A * 8/1987 Escher ..... A63B 21/00061 601/87
5,150,625 A * 9/1992 Mishler ..... A63B 21/222 446/233
5,353,655 A 10/1994 Mishler
5,386,738 A * 2/1995 Havenhill ..... G01C 19/30 74/5.22
5,766,112 A * 6/1998 Chuan ..... A63B 21/045 482/121

(Continued)

*Primary Examiner* — Alexander R Niconovich

(74) *Attorney, Agent, or Firm* — Boyle Fredrickson, S.C.

(57) ABSTRACT

A hand-held gyroscope toy or gyroscopic muscle conditioning device with an outer shell containing a drive assembly with a spring-loaded drive button at one end that charges and discharges the gearing inside to provide an accelerated rate of rotation to a flywheel inside the outer shell. The resulting high-speed rotation causes a gyro effect that can be employed as either a fidget-type toy or a resistance device for fine motor or muscle development.

8 Claims, 4 Drawing Sheets

(56) References Cited

U.S. PATENT DOCUMENTS 5,800,311 A * 9/1998 Chuang ..... A63B 23/14 482/44
6,053,846 A * 4/2000 Lin ..... A63B 21/22 482/44
6,186,914 B1 * 2/2001 Lin ..... A63B 21/222 482/44
6,406,349 B1 * 6/2002 Chung ..... A63H 1/04 446/233
6,623,405 B2 * 9/2003 Chuang ..... A63B 23/14 482/44
6,770,012 B2 * 8/2004 Kuo ..... A63B 21/222 446/248
6,773,377 B1 * 8/2004 Yu ..... A61H 7/003 482/110
6,942,601 B2 * 9/2005 Chuang ..... A63B 21/222 482/44
7,033,304 B2 * 4/2006 Chuang ..... A63B 21/222 482/45
7,077,786 B2 * 7/2006 Chuang ..... A63B 21/0608 482/44
7,086,990 B2 * 8/2006 Chuang ..... A63B 23/14 482/44
7,101,315 B2 * 9/2006 Chuang ..... A63B 23/14 482/3
7,102,258 B2 * 9/2006 Shen ..... A63B 21/222 482/44
7,326,156 B2 * 2/2008 Dworzan ..... A63B 21/222 482/44
7,381,155 B2 * 6/2008 Chuang ..... A63B 23/16 482/45
7,736,275 B2 * 6/2010 Chuang ..... A63B 23/14 446/233
7,736,276 B2 * 6/2010 Chuang ..... A63B 21/222 446/233
7,846,066 B1 * 12/2010 Chuang ..... H05B 47/105 482/44
8,652,012 B2 * 2/2014 Smith ..... A63B 21/222 446/233
8,834,322 B2 * 9/2014 Chuang ..... A63B 21/0004 482/44
8,926,396 B2 * 1/2015 Lennon ..... A63H 29/20 446/233
9,155,935 B2 * 10/2015 Kelliher ..... A63B 21/222
9,463,354 B2 * 10/2016 Chuang ..... A63B 21/222
9,827,463 B2 * 11/2017 Chuang ..... A63B 23/14
10,252,151 B2 * 4/2019 Ben-Haim ..... A63B 21/222
11,806,570 B2 * 11/2023 Chuang ..... A63B 21/0057
11,904,197 B2 * 2/2024 Chuang ..... A63B 21/0004
2002/0068663 A1 * 6/2002 Smith ..... A63B 21/22 482/110
2005/0101440 A1 * 5/2005 Chuang ..... A63B 23/16 482/110
2013/0178336 A1 * 7/2013 Chuang ..... A63B 71/0622 482/8
2013/0303337 A1 * 11/2013 Chuang ..... A63B 21/222 482/45
2014/0155226 A1 * 6/2014 Chuang ..... A63B 21/0004 482/46
2023/0023019 A1 * 1/2023 Ong ..... A63B 21/0059

* cited by examiner

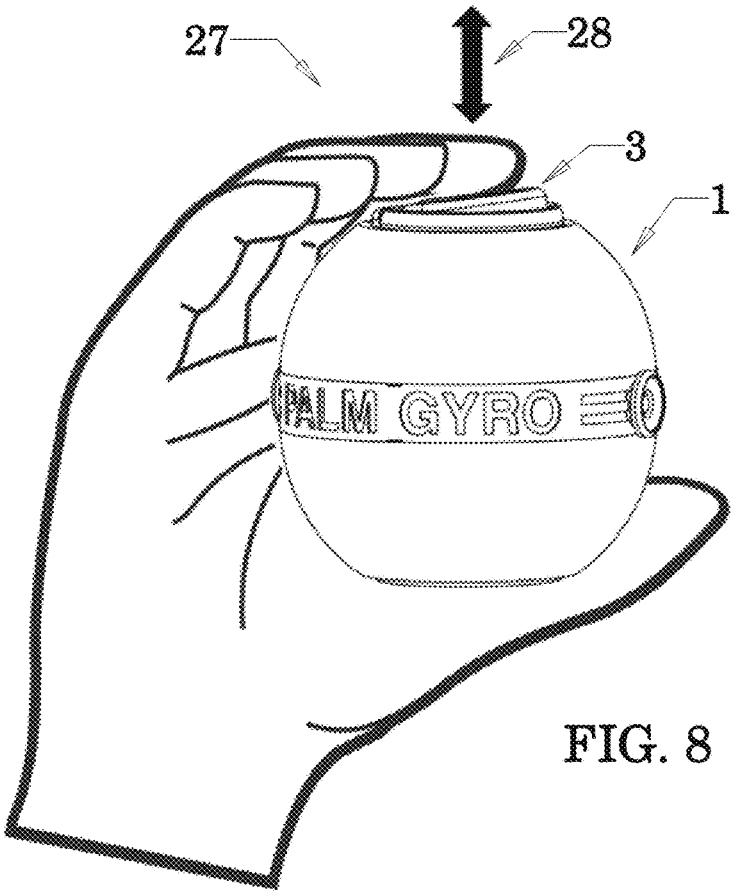
FIG. 8
FIG. 9
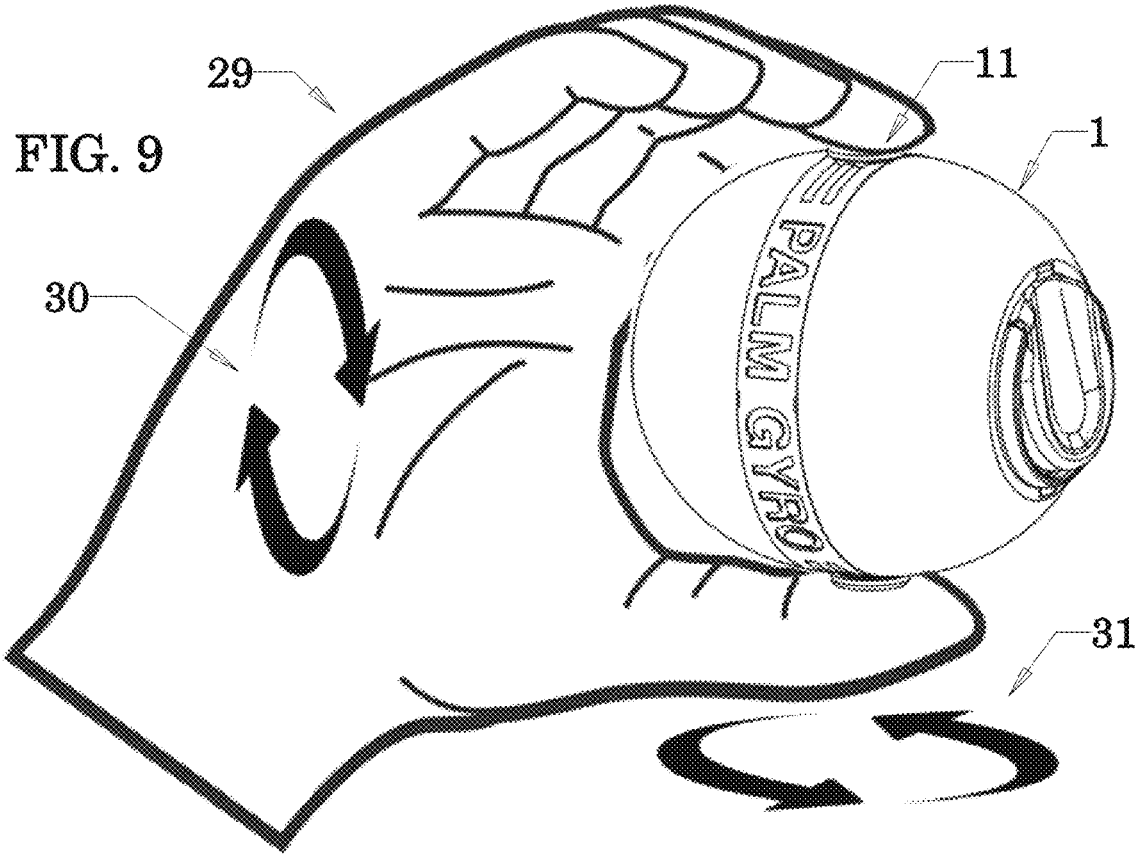

HAND OPERATED GYROSCOPE DEVICE

This application claims the benefit of U.S. Provisional Application 63/386,579 filed Dec. 8, 2022 and hereby incorporated by reference.

BACKGROUND OF THE INVENTION

The present invention relates to both gyroscope toys and gyro muscle development devices and in particular to a gyroscope device having a hand-held outer shell containing a drive assembly with a spring-loaded finger-drive button that retractably charges and discharges the gearing in an engine assembly which imparts continually accelerated rotation to a flywheel assembly contained within the outer shell. The gearing in the engine assembly is arranged such that the idler gear alternately attaches to the input side of the system when the drive button is depressed to charge the coil spring and subsequently the idler gear attaches to the output side of the system while also inducing a recovery force on the input side of the system returning the drive button to its ready position. Thus, the engine assembly provides increasing acceleration of the flywheel rotation imparted by successive cycles of the drive button. The resulting high-speed rotation causes a gyro effect that can be employed both as a fidget-type toy or a resistance exercise device for muscle development or occupational therapy.

Gyro toys and gyroscopic muscle conditioning devices are well known in the art. Typical gyro devices employ hand wound string on the shaft of the gyro as a means to rapidly accelerate the flywheel. Such gyroscope devices provide limited play value due to the time consuming and tedious effort required to activate the desired gyroscopic rotation. In addition, such traditional gyro devices cannot be hand-held. A motor driven hand-held gyroscope device is described in U.S. Pat. No. 10,252,151 in which two gyros are suspended on a handle. However, the batteries and motor are a complex and costly approach to such a consumer product. Alternately, U.S. Pat. No. 5,353,655 is a hand-held gyroscope accelerated by means of suspending a rotating element within a shell that contains an opening such that an exposed segment of the rotating element can be successively dragged across a surface by the user to develop the desired gyroscopic effect. Such resistive motion gyro products are promoted for strength and conditioning. However, due to the limited potential rotational rate and inconvenient repeatability of this dragging method, the usefulness is minimized. Additionally, these approaches do not provide the engaging user feedback of the rhythmic manual manipulation of the finger-driven gyroscope system herein described.

In order to improve both the play value as well as the strength and fine motor skill benefits of a gyroscope, what is needed is a hand-held device that allows the user to easily charge the gyro system to a high rate of rotational motion by means of a simple and convenient charging mechanism that may be employed repeatably while holding the device in their hand.

BRIEF SUMMARY OF THE INVENTION

The present invention provides a hand-held gyroscope device having an outer shell that houses an engine assembly with a drive button and spring loaded gearing such that when the drive button is actuated in a repeatable reciprocal motion the gearing is alternately engaged and disengaged from a flywheel to impart increasingly accelerated rotational motion to the flywheel, thus creating a gyro effect.

Specifically, the present invention provides a gyroscope device with an outer shell that houses a drive assembly. The drive assembly has a drive button exposed on one side and hinged to provide a means to actuate a rack gear which imparts a subsequent rotation of an input pinion gear further linked to a coil spring gear in the engine assembly. The input pinion gear has a gear ratio such that the linear motion of the input rack gear provides amplified rotation of the coil spring gear thus increasing the stored energy in the coil spring. This first arrangement of gears charges and discharges the series of gears on the input side of the engine assembly when the drive button is reciprocally manipulated by the finger of the user. Spring-loading the input side of the system also allows the drive button to be reset to its original position when the finger pressure is released. The reversible, repeatable cycle of this input method allows the user to incrementally accelerate the flywheel rotation manually with tactile feedback from the gear system in a desirable rhythmic motion.

Thus it is one object of the invention that the gyro device has a drive assembly containing a drive button to manually charge the gear system of the engine housing when the button is depressed.

Thus it is another object of the invention that the input side of the engine assembly has a rack and pinion receiving set linked to a coil spring gear.

Thus it is another object of the invention that actuating the drive button reversibly charges and discharges the coil spring gear to reset the system when the drive button is reciprocally depressed and released.

The engine assembly further contains an idler gear that rests in a slot disposed between the coil spring gear and the output gear set. The idler gear teeth are continually linked to the coil spring gear so that the direction of the coil spring gear rotation influences which of two positions the idler will take in the slot. Thus as the drive button is being depressed, the coil spring rotates in a direction to charge the spring as the idler gear is influenced to free itself from the output gear and rest in a neutral position disengaged from the output side of the gear system. Conversely, when the drive button is released the coil spring gear rotates in the discharging direction and the idler gear is influenced to engage the output gear of the engine assembly, thus transferring the spring loaded rotation from the coil spring gear through the idler gear to an output gear and finally to the axle gear of flywheel assembly. The gear ratios of this system are such that repeated cycles of the input rack gear induce ever increasing rotational speed of the flywheel assembly of the gyro device.

Thus it is another object of the invention that an idler gear allows for a detachable transition between the input side and output side of the engine assembly gear system.

Thus it another object of the invention that the two alternate positions of the idler gear are influenced by the coil spring gear rotational direction.

Thus it is another object of the invention that the charging rotational direction of the coil spring gear influences the idler gear to shift to a neutral position disengaged from the output side of the gear system.

Thus it is another object of the invention that the discharging rotational direction of the coil spring gear influences the idler gear to shift to a position of engagement with the output gear thereby transferring the spring-loaded rotation to the axle gear of the flywheel assembly.

Thus it is another object of the invention that the gear ratios are such that repeated cycles of the input rack gear induce increasing rotational speed of the flywheel assembly of the gyro device.

For the present embodiment of the device, the flywheel assembly of the gyroscope has two flywheel hubs connected to the flywheel axle and positioned on either side of the drive assembly. Each of the two hubs hold a balanced weight in the form of metal rings. The overall drive assembly is contained in two partial spheres that are joined by a center collar. The semi-spherical outer shells are translucent to allow for viewing the motion of the flywheel assembly. Each flywheel hub has a centrifugal switch that triggers a light when the rotation is sufficient to activate the switch. The center collar carries two rotation buttons on opposing sides of the collar and radially aligned 90 degrees to the flywheel assembly axis and by which the charged gyro device may be held allowing the entire device to rotate freely due to the influence of the gyro dynamics. For added play value, the device can be rocked back and forth in the hand to impart increased rotational rate and also cause a sudden reversal of the rotational direction.

Thus it is an object of the invention to house the drive assembly in an outer shell with a center collar.

Thus it is another object of the invention to have a set of centrifugal switches to trigger lights when the gyro is rings are set in motion.

Thus it is another object of the invention to have opposing buttons in the outer shell to allow the user to hold the device and observe the physical effects of the gyro motion.

BRIEF DESCRIPTION OF THE SEVERAL VIEWS OF THE DRAWINGS

FIG. 8 is a graphic showing the gyro device in the hand-held finger charging position.

FIG. 9 is a graphic showing the gyro device freely rotating held by the rotation buttons.

| | |
|---|---|
| 1 | Gryo Device |
| 2 | Drive Assembly |
| 3 | Drive Button |
| 4 | Upper Outer Shell |
| 5 | Lower Outer Shell |
| 6 | Upper Engine Housing |
| 7 | Lower Engine Housing |
| 8 | Engine Assembly |

-continued

| | |
|---|---|
| 9 | Flywheel Assembly |
| 10 | Center Collar |
| 11 | Rotation Buttons |
| 12 | Primary Bearing Cradles |
| 13 | Snap Beads |
| 14 | Flywheel Hub |
| 15 | Metal Ring |
| 16 | Input Rack Gear |
| 17 | Input Pinion Gear |
| 18 | Coil Spring Gear |
| 19 | Idler Gear |
| 20 | Output Gear |
| 21 | Flywheel Gear |
| 22 | Fly Wheel Axle |
| 23 | Flywheel Bearings |
| 24 | Rotation Button Bearings |
| 25 | Drive Button Axle |
| 26 | Rack Gear Guide |
| 27 | Charging Position |
| 28 | Charging Motion Symbol |
| 29 | Rotation Position |
| 30 | Hand Articulation Symbol |
| 31 | Gyro Induced Rotation |

DETAILED DESCRIPTION OF THE INVENTION

Background Design

Figure 1:
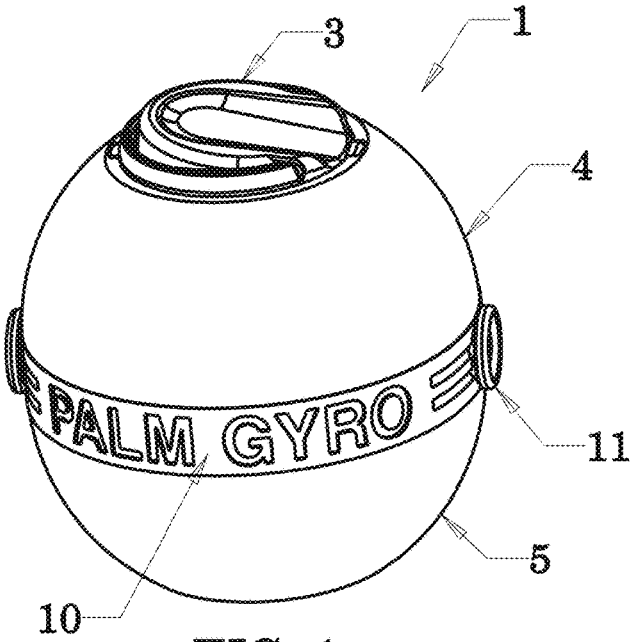
FIG. 1 is a perspective view of the gyroscope device showing the outer shell and center collar with the two rotation buttons. The drive button of the drive assembly can be seen at the top of the device.

Referring now to FIG. 1, a gyro devise 1 of the present invention includes an upper outer shell 4 and lower outer shell 5 held together by a center collar 10 and having a drive button 3 at one end and two rotation buttons 11 on opposing sides of the center collar 10.

Figure 2:
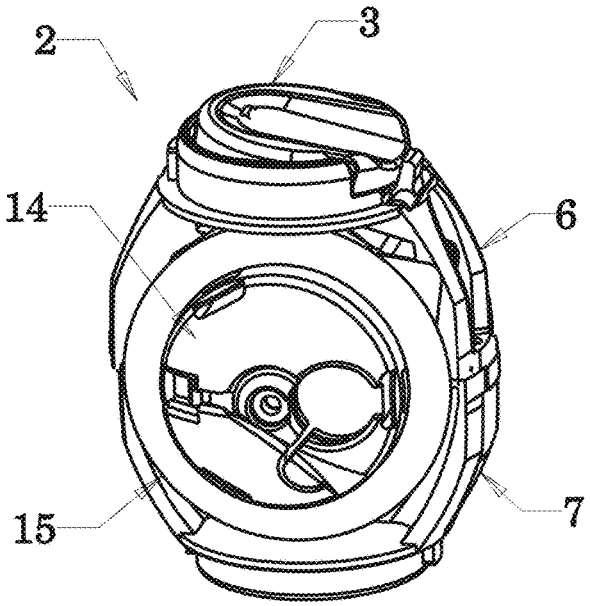
FIG. 2 is a perspective view of the drive assembly showing the drive button, the upper and lower engine housing and the flywheel assembly with the flywheel hub and metal ring.

Referring now to FIG. 2, the engine assembly 8 is housed within the outer shell of the gyro device 1. The engine assembly 8 includes a lower engine housing 7, an upper engine housing 6 and a drive button 3 connected to the upper engine housing 6.

Figure 3:
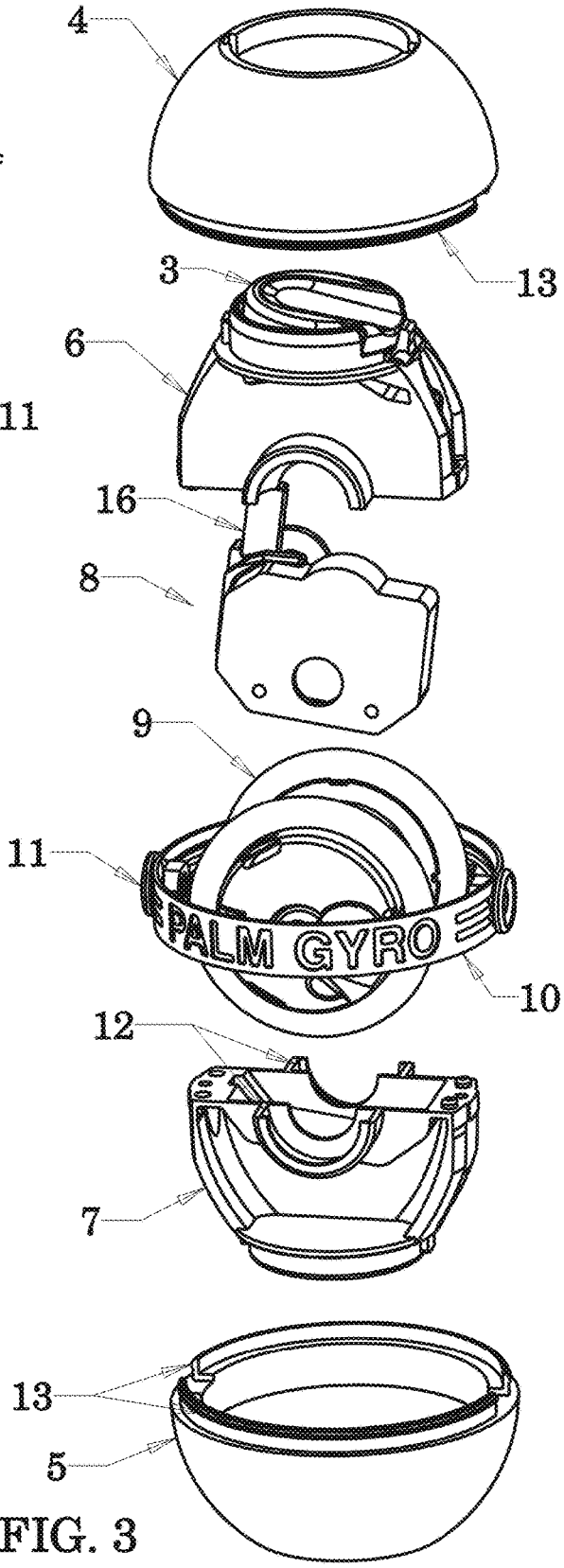
FIG. 3 is an exploded perspective view of the entire device showing all the components and the relative radial orientation of the flywheel assembly aligned 90 degrees to the rotation buttons.

Referring now to FIG. 3, the overall assembly of the gyro device 1 is shown including the components of the drive assembly 2 comprising the upper engine housing 6, the lower engine housing 7, and the engine assembly 8 that is nested between these two elements. The drive button 3 is disposed to contact the input rack gear 16 protruding from the engine assembly 8. When in use the flywheel assembly 9 is driven by the engine assembly 8.

Figure 4:
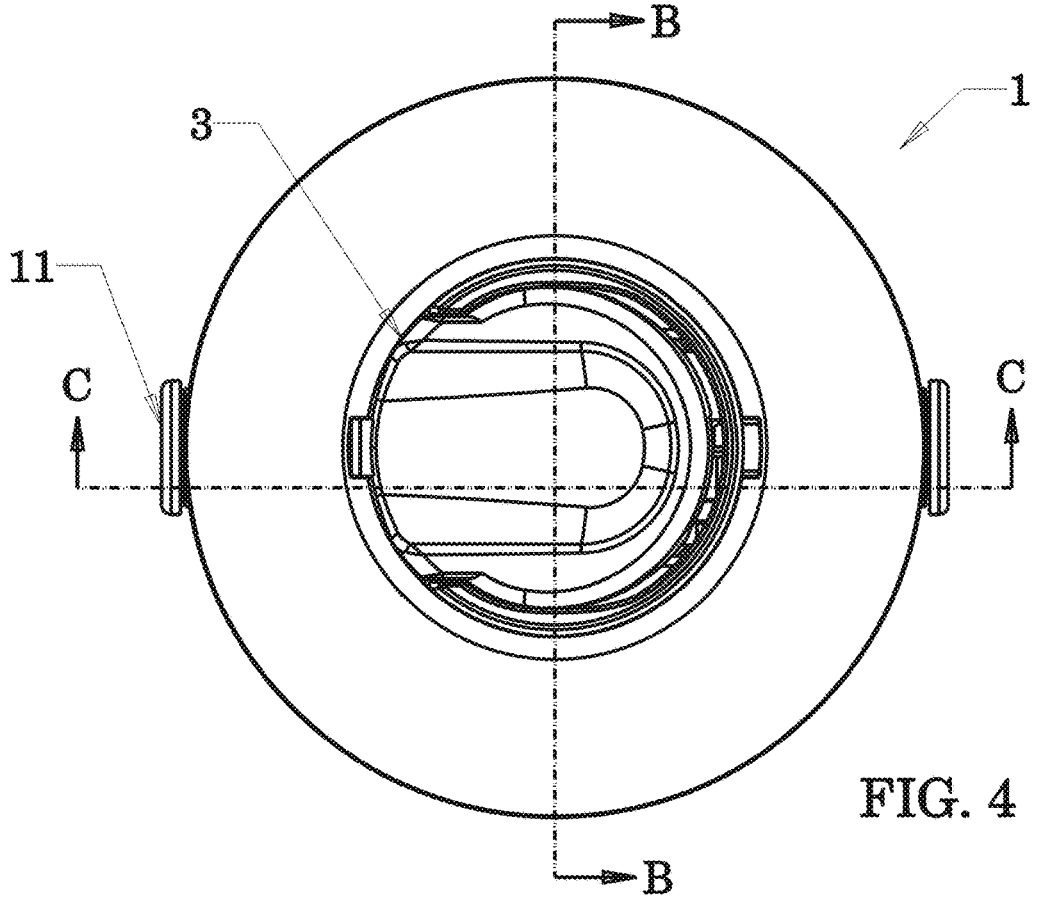
FIG. 4 is a top plan view showing the drive button.

Referring now to FIG. 4, a top view of the gyroscope device 1 shows the drive button 3 at the top center and the two rotation buttons 11 at the sides. Using the Section "B" line as a reference, this location ascribes a centerline through flywheel assembly 9 at the axis of the flywheel axle 22.

The Section "C" line reference is an offset cutting plane through the input rack gear 16 and the smaller gear diameter of the input pinion gear 17.

Figure 5:
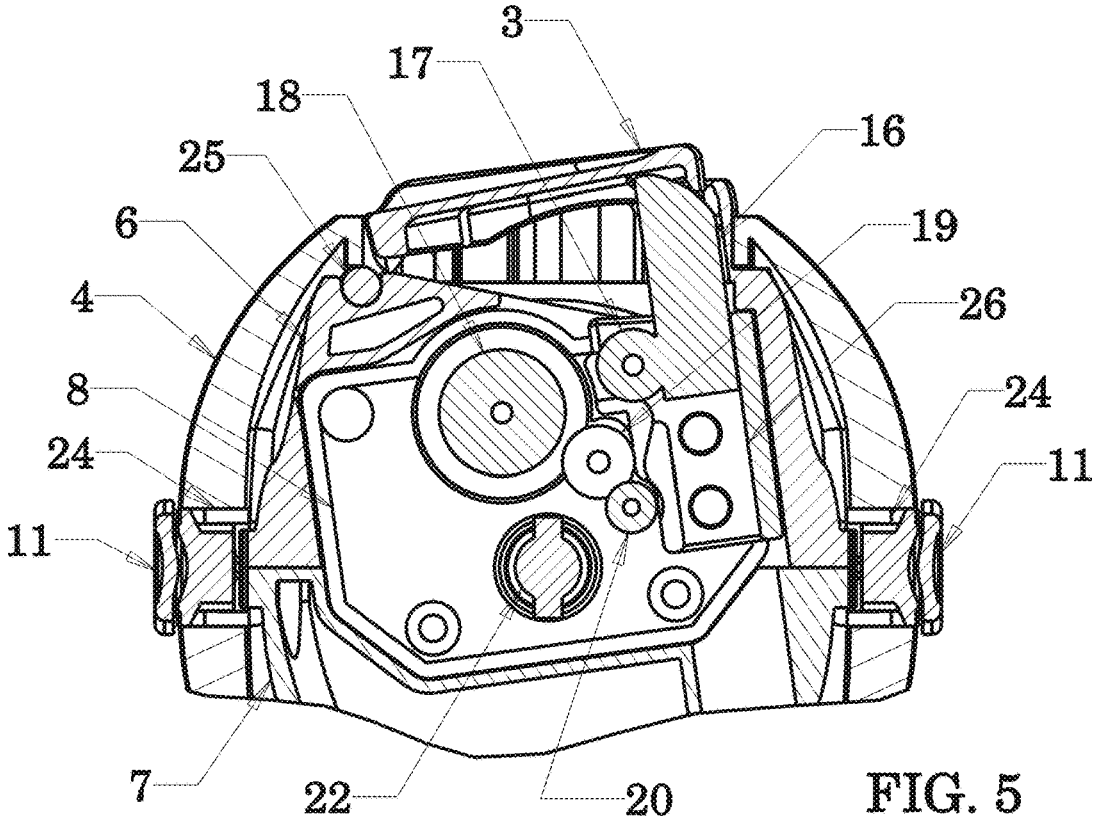
FIG. 5 is a side section view of FIG. 4 offset through the input rack and pinion gears of the engine assembly which is housed in the upper and lower engine housings.

Referring now to FIG. 5, Section "C" is a front section view through the input rack gear 16 and the input pinion gear 17 and showing the engine assembly 8 nested between the upper engine housing 6 and lower engine housing 7. The upper outer shell 4 captures the drive button 3, and the drive button axle 25 is nested into a rocker slot in the upper engine housing 6. The drive button 3 is shown contacting the input rack gear 16. The rack gear guide 26 is adjacent to the input rack gear 16 as shown. The two opposing rotation buttons 11 are shown held in the side wall of the center collar 10 by two rotation button bearings 24. The flywheel axle 22 of the flywheel assembly 9 is shown running perpendicular to the section planc.

Figure 6:
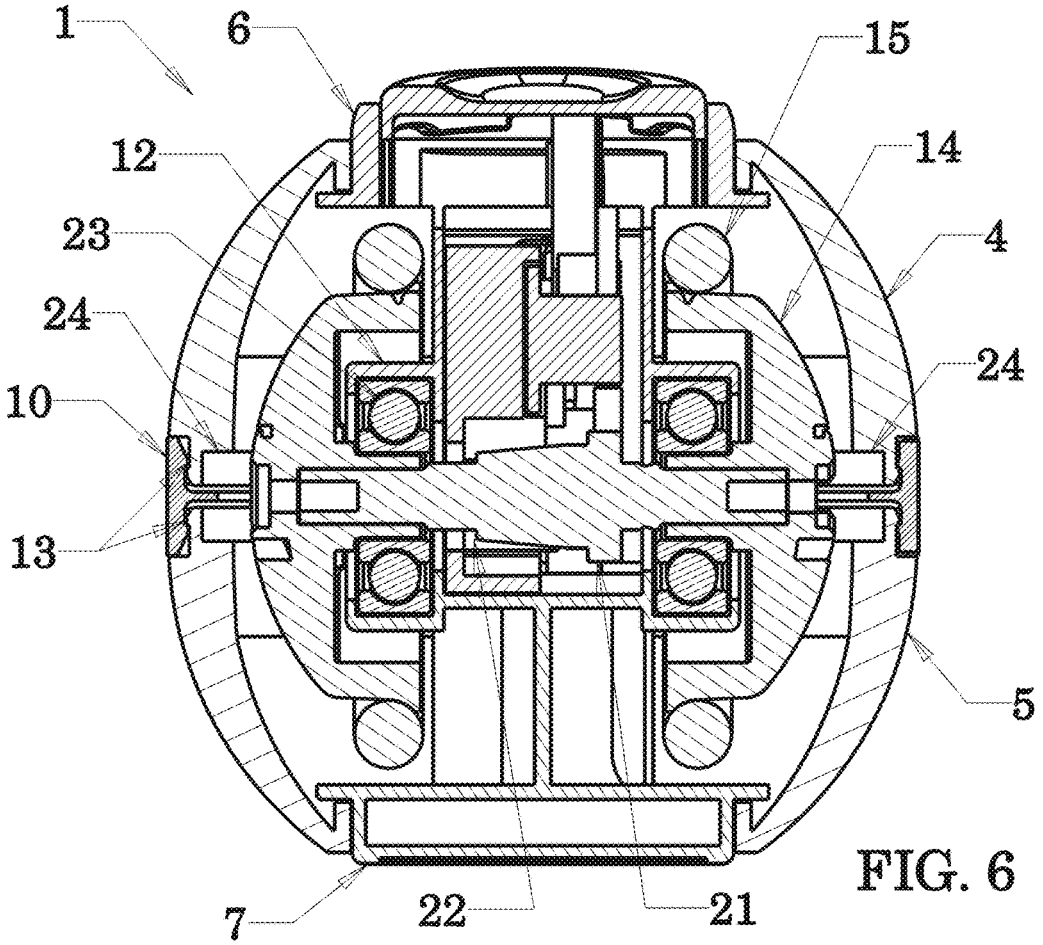
FIG. 6 is a side section view of the entire device showing the center collar snap features, the outer shell and the flywheel bearings that carry the flywheel hub for the flywheel assembly.

Referring now to FIG. 6, Section "B" is a side section view through the center axis of the of the flywheel axle 22 showing the flywheel assembly 9 including the two metal rings 15 attached to the two flywheel hubs 14. The two flywheel bearings 23 contact the two flywheel hubs 14 to carry the flywheel assembly 9. The two snap beads 13 on the inner face of the center collar 10 attach both the upper outer shell 4 and lower outer shell 5. The upper outer shell 4 and lower outer shell 5 are shown capturing the upper engine housing 6 and lower engine housing 7 of the engine assembly 8, thus suspending the engine assembly 8 within the outer shell.

Figure 7:
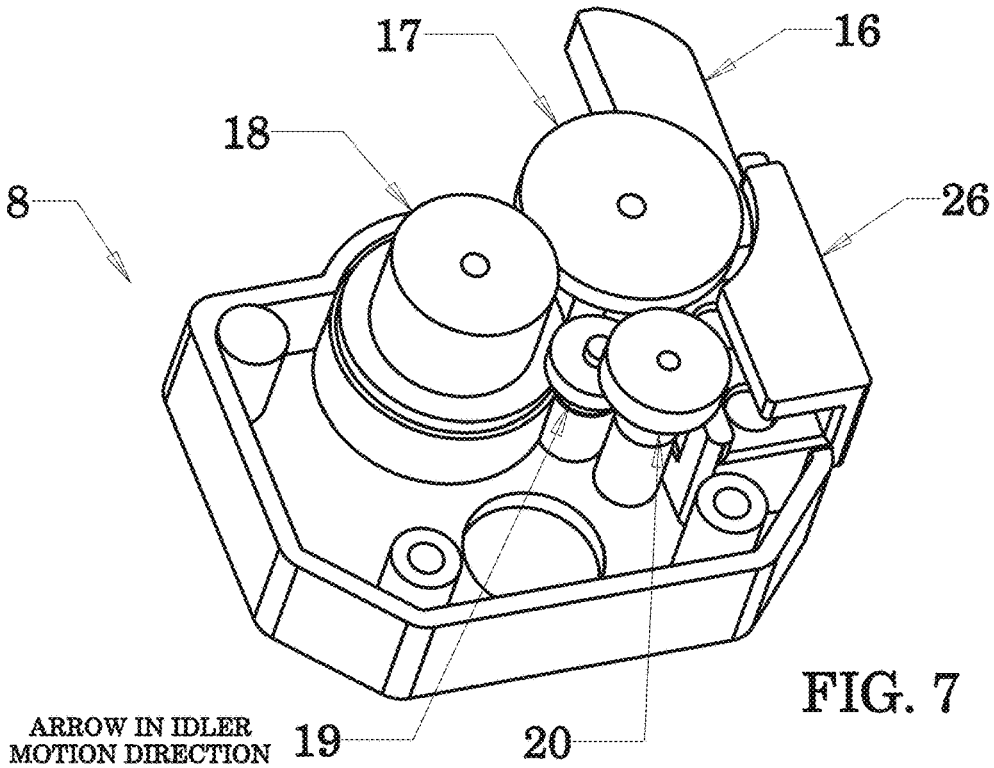
FIG. 7 is an interior perspective view of the engine assembly showing the various gear elements and their relative arrangement.

Referring now to FIG. 7, an interior perspective view of the engine assembly 8 shows the arrangement of the gears. The input rack gear 16 contacts the smaller diameter gear teeth of the input pinion gear 17 whose larger diameter gears contact the smaller gear of the coil spring gear 18. The larger gear of the coil spring gear 18 contacts the idler gear 19 such that the direction of rotation of the coil spring gear 18 influences the idler gear 19 to ride freely back and forth in a slot, and thus the idler gear 19 alternates between a first neutral position disconnected from the output side of the system and a second output position connected to the small diameter of the output gear 20. The large diameter of the output gear 20 finally connects to a gear on the flywheel axle 22. The gear ratios are such that repeated cycles of the input rack gear 16 induce increasing rotational speed of the flywheel assembly 9 of the gyro device 1.

Referring now to FIG. 8, the graphic shows the hand-held charging position 27 for the gyro device 1. The charging motion symbol 28 indicates the repeated manual actuation of the input drive button 3.

Referring now to FIG. 9, the graphic shows the hand-held rotation position 29 for the gyro device 1. The hand articulation motion symbol 30 indicates the manual back and forth tilting motion of the hand while holding the rotation buttons 11 which allows for gyro induced rotation 31 of the gyro device 1.

Generally then the invention can provide a hand-held gyroscope toy or gyroscopic muscle conditioning device with an outer shell containing a drive assembly with a spring-loaded drive button exposed at one end that retractably charges and discharges the gearing of a drive assembly to impart continually accelerated rotation of a flywheel contained within the outer shell. The resulting high speed rotation causes a gyro effect that can be employed both as a fidget-type toy or a resistance device for fine motor or muscle development. Buttons on two sides of the outer shell allow the device to be held and rotate freely demonstrating the physical effects of the gyroscopic rotation. Thus the device would be an entertaining fidget toy that is interesting to activate, hold and observe as well as a useful resistance exercise device for strength conditioning or occupational therapy recovery.

The above description has been that of a preferred embodiment of the present invention, and it will occur to those that practice the art that many modifications may be made without departing from the spirit and scope of the invention. A number of different types of gearing systems and alternate spring designs may be employed to provide optimal rotational output of the gyro device described herein. Similarly, alternate housing and bearing arrangements could be devised for case of manufacture. In order to apprise the public of the various embodiments that may fall within the scope of the invention, the following claims are made.

I claim:

1. A gyroscope device comprising:

an outer shell housing having a cutout at a topmost point and having an ovoid shape adapted to be held in a hand of a user;

an engine assembly housed within the outer shell housing;

a manually actuatable drive button extending through a cutout at the topmost point of the outer shell housing and mechanically communicating with the engine assembly to induce a gyroscopic effect by rotating a flywheel;

wherein the manually actuatable drive button has a surface exposed from the outer shell housing adapted to be pressed by a finger of the hand of the user holding the outer shell housing toward the outer shell housing; and wherein the engine assembly has an input set of gears operatively connected to an output set of gears and a spring gear such that induces rotation of the flywheel with repeated successive pressings of the manually actuatable drive button.

2. The gyroscope device of claim 1 wherein the outer shell housing has an upper outer shell and a lower outer shell.

3. The gyroscope device of claim 2 wherein the upper outer shell and the lower outer shell are joined by a center collar.

4. The gyroscope device of claim 1 wherein the outer shell housing includes a set of rotation buttons diametrically opposed along a spherical axis of the outer shell housing and adapted to allow the hand of the user to hold the gyroscope device.

5. The gyroscopic device of claim 4 wherein the set of rotation buttons are aligned on an axis perpendicular to a rotational plane of the flywheel.

6. The gyroscopic device of claim 1 wherein the spring gear is a coil spring.

7. The gyroscopic device of claim 1 whereby wherein a rack and pinion gear set provides a rotational spring bias to the spring gear.

8. The gyroscopic device of claim 7 wherein the rotational spring bias of the spring gear resets the drive button to a non-actuated initial position.

* * * * *